US007549713B2

(12) United States Patent
Gose et al.

(10) Patent No.: US 7,549,713 B2
(45) Date of Patent: Jun. 23, 2009

(54) REFRIGERATOR HANDLE MOUNTING ARRANGEMENT

(75) Inventors: Thomas E. Gose, Cedar Rapids, IA (US); Forrest F. Wing, Des Moines, IA (US)

(73) Assignee: Maytag Corporation, Benton Harbor, MI (US)

( * ) Notice: Subject to any disclaimer, the term of this patent is extended or adjusted under 35 U.S.C. 154(b) by 832 days.

(21) Appl. No.: 10/295,850

(22) Filed: Nov. 18, 2002

(65) Prior Publication Data

US 2004/0094560 A1 May 20, 2004

(51) Int. Cl.
*A47B 96/04* (2006.01)

(52) U.S. Cl. ..... 312/405; 16/412; 16/436

(58) Field of Classification Search ..... 312/405, 312/244, 348.6; 16/110.1, 412, 111.1, 413, 16/436, 444, DIG. 40, DIG. 41
See application file for complete search history.

(56) References Cited

U.S. PATENT DOCUMENTS

| | | | | | |
|---|---|---|---|---|---|
| 2,175,632 | A | * | 10/1939 | Maga | 16/422 |
| 2,234,097 | A | | 3/1941 | Tinnerman | |
| 2,472,479 | A | | 6/1949 | Hoff | |
| 3,426,385 | A | | 2/1969 | Gutshall | |
| 3,766,598 | A | | 10/1973 | Roberts | |
| 3,995,349 | A | | 12/1976 | Roberts et al. | |
| 4,087,141 | A | | 5/1978 | Roberts | |
| 4,408,432 | A | * | 10/1983 | Carter et al. | 52/718.04 |
| 4,540,207 | A | | 9/1985 | Klasen et al. | |
| 4,745,656 | A | | 5/1988 | Revlett | |
| 4,922,576 | A | | 5/1990 | Weidner et al. | |
| 5,193,244 | A | | 3/1993 | Meyers | |
| 5,303,445 | A | | 4/1994 | Meyers | |
| 5,402,553 | A | | 4/1995 | Goetz et al. | |
| 5,493,756 | A | | 2/1996 | Shanok et al. | |
| 5,659,927 | A | | 8/1997 | Shanok et al. | |
| 5,675,867 | A | | 10/1997 | Howie, Jr. | |
| 5,740,587 | A | | 4/1998 | Onai et al. | |
| 5,797,164 | A | | 8/1998 | Donaghy | |
| 5,832,564 | A | * | 11/1998 | Shanok | 16/436 |
| 6,019,447 | A | | 2/2000 | Jackovin | |
| 6,450,364 | B1 | | 9/2002 | Nam | |
| 6,546,597 | B2 | * | 4/2003 | Atalla et al. | 16/444 |
| 6,609,274 | B2 | | 8/2003 | Christensen et al. | |
| 6,735,824 | B2 | * | 5/2004 | Tisol Jr. et al. | 16/412 |
| 2003/0079313 | A1 | | 5/2003 | Pohl et al. | |
| 2003/0106185 | A1 | * | 6/2003 | Worrell | 16/444 |

FOREIGN PATENT DOCUMENTS

| | | | |
|---|---|---|---|
| JP | 03-031684 | | 2/1991 |
| JP | 2000028259 | * | 1/2000 |
| JP | 2001-50651 | | 2/2001 |
| JP | 2001-336872 | | 12/2001 |

* cited by examiner

*Primary Examiner*—Hanh V Tran
(74) *Attorney, Agent, or Firm*—Kirk Goodwin; Michael D. Lafrenz

(57) ABSTRACT

A refrigerator handle assembly includes a plurality of base members which are initially attached at spaced longitudinal positions to a front face portion of a refrigerator door, with tab elements of the base members extending into openings formed in the door and screws fixing the base members in place. The handle assembly also includes a plurality of handle clip members positioned within recesses formed in end portions of a handle member. Once the base members are secured, sections of the handle are placed over the base members and the handle is slid relative to the base members whereupon portions of the base members become engaged and co-act with the handle clip members such that the handle member is drawn tight to the front face portion of the door and releasably locked in position.

19 Claims, 8 Drawing Sheets

REFRIGERATOR HANDLE MOUNTING ARRANGEMENT

BACKGROUND OF THE INVENTION

1. Field of the Invention

The present invention pertains to the art of refrigerators and, more particularly, to a mounting arrangement for a handle on a refrigerator.

2. Discussion of the Prior Art

Conventional handle arrangements for refrigerators are formed from multiple pieces, including a handle frame and a handle piece having a gripping portion. Such a handle is typically mounted to a refrigerator cabinet utilizing screws which extend through the handle piece and frame, clamping the overall handle to a panel of the refrigerator cabinet. Once the handle is in place, a cover is inserted over the screw, with the cover extending only over the area of the screws or along substantially the entire length of the handle. In general, this known handle mounting arrangement is rather hard to assemble and often results in witness lines that take away from the overall aesthetics of the refrigerator.

Regardless of the existence of various types of refrigerator handle arrangements and mounting systems therefor, there still exists a need in the art for an improved refrigerator handle mounting arrangement preferably, but certainly not limited to, surface mounting a handle to a refrigerator in a manner which provides a tight, aesthetically appealing and easily assembled overall arrangement.

SUMMARY OF THE INVENTION

The present invention pertains to the mounting of a handle to a door panel face of a refrigerator. In accordance with the most preferred form of the invention, a plurality of base fastener members or spring clip pieces are initially attached at longitudinally spaced positions to the face of the refrigerator, preferably through the use of mechanical connections after the refrigerator door is foam insulated. In addition, a pair of handle clips are pre-installed, preferably in a snap-fit manner or through the use of mechanical fasteners, to back side portions of an injection molded handle. The door mounted clips mate with the handle clips to establish a combination slide and snap lock attachment.

More specifically, the handle is initially positioned over the door clips and shifted relative to the door, whereupon the door clips become interengaged with the handle clips. During this sliding action, angled portions on the door clips co-act with structure of the handle clips such that a wedging action is developed to draw the handle tight to the door panel. In addition, a cantilevered portion of at least one of the handle clips further snap locks into engagement with a respective one of the door clips to prevent relative shifting between the handle and the door. However, the cantilevered portion can be manually deflected if removal of the handle is required. More specifically, the locking engagement can be released by inserting a rod into a channel molded through a wall portion of the handle and deflecting the cantilevered portion.

Additional objects, features and advantages of the present invention will be more readily apparent from the following detailed description of a preferred embodiment of the invention, when taken in conjunction with the drawings wherein like reference numerals refer to corresponding parts in the several views.

DETAILED DESCRIPTION OF THE PREFERRED EMBODIMENTS

Figure 1:
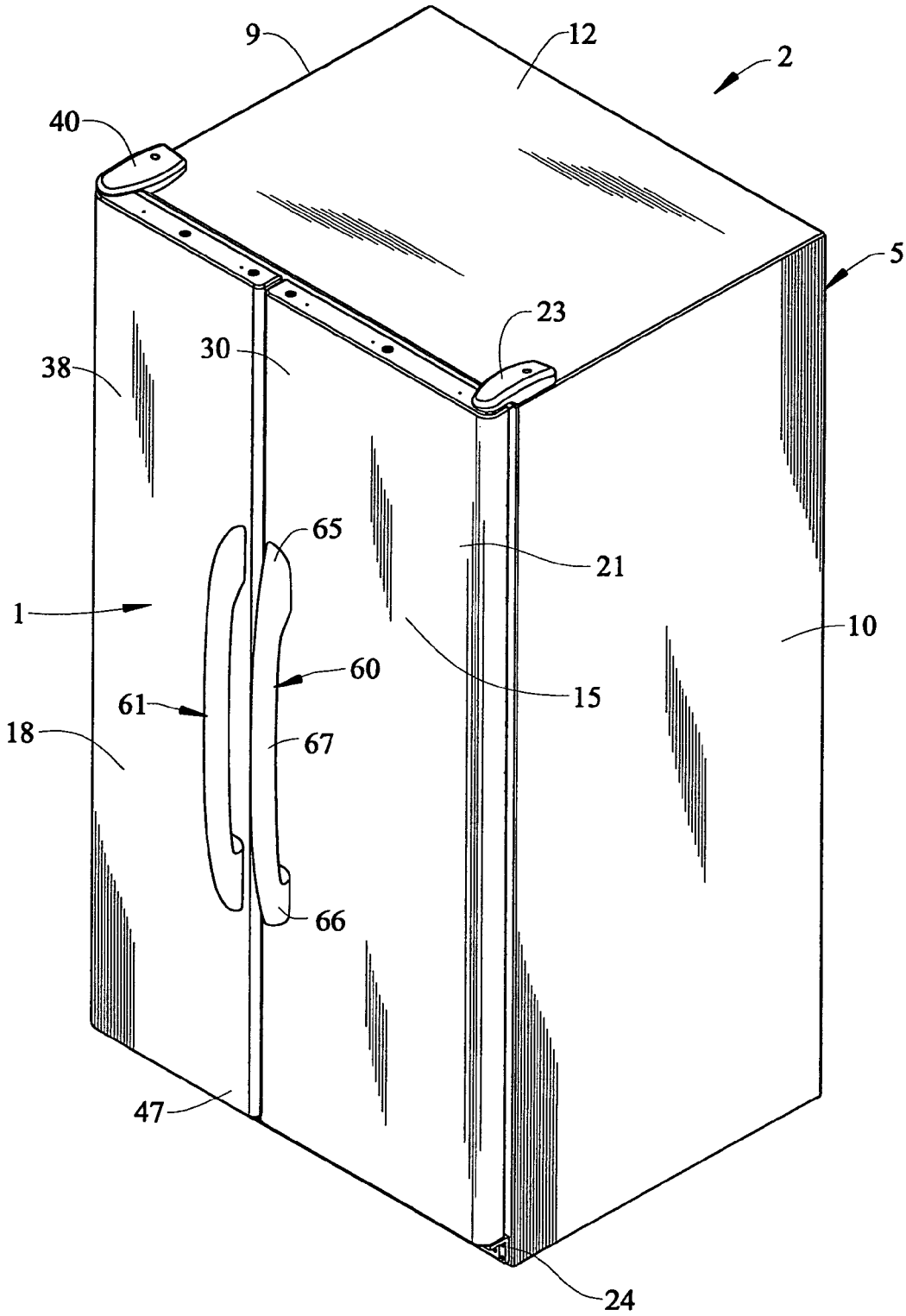
FIG. 1 is upper right front perspective view of a refrigerator cabinet incorporating a refrigerator door handle arrangement constructed in accordance with a preferred embodiment of the present invention.
Figure 2:
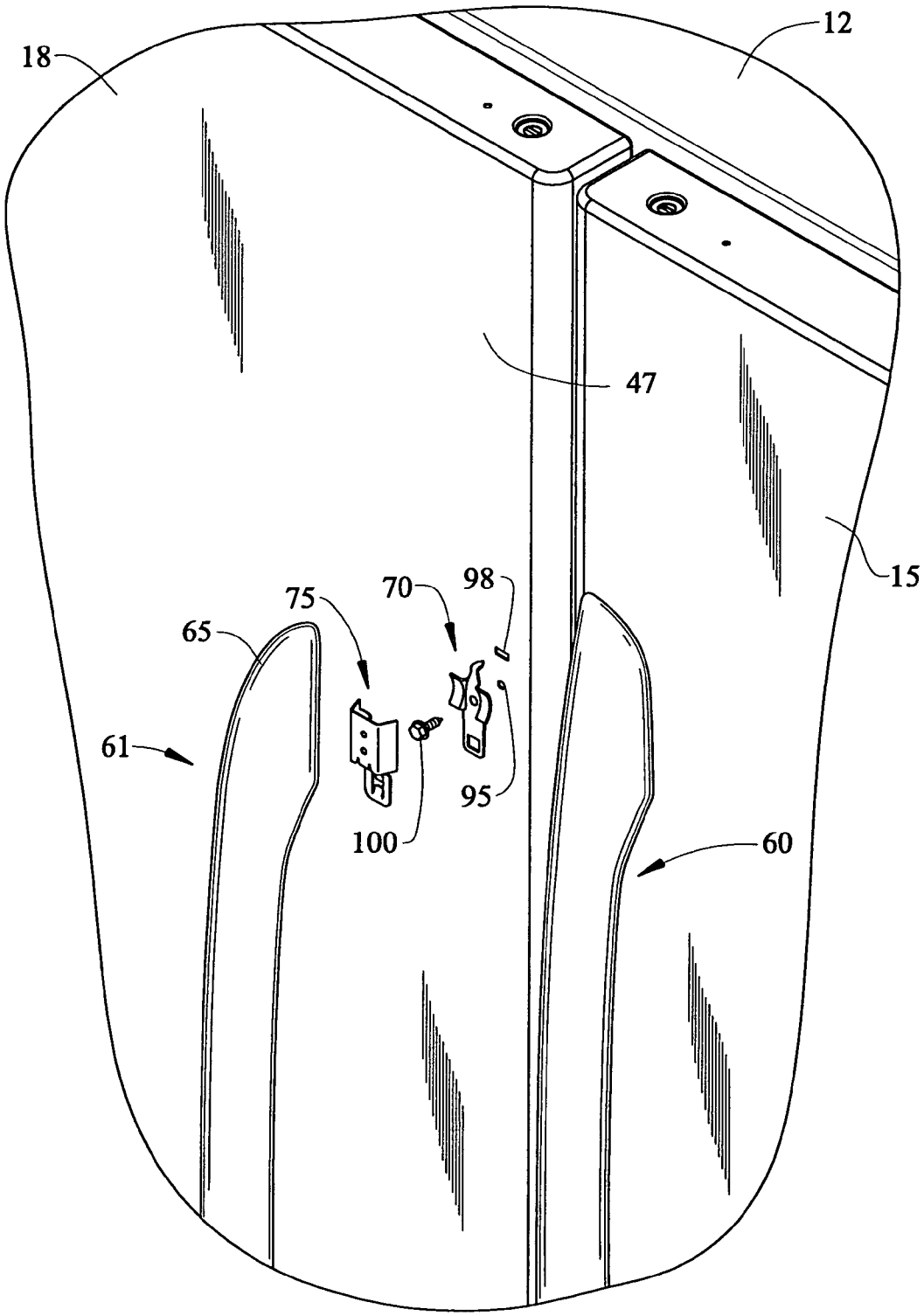
FIG. 2 is a partial exploded view of an upper portion of the handle arrangement of FIG. 1.

With initial reference to FIG. 1, the handle arrangement 1 of the invention is shown mounted to a refrigerator cabinet which is generally indicated at 2. Although handle arrangement 1 can be applied to various different types and styles of refrigerators, as shown, refrigerator cabinet 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator cabinet 2 constitutes a side-by-side refrigerator having a fresh food compartment door 15 which is arranged laterally juxtaposed to a freezer door 18. Aside from the aspects which will be described more fully below, the basic construction and operation of refrigerator cabinet 2 is known in the art, does not form part of the present invention, and therefore will not be discussed further herein.

Fresh food door 15 includes an outer vertical edge portion 21, which is pivotally attached to cabinet shell 5 through upper hinge 23 and a lower hinge 24, and an inner vertical edge portion 30. In a generally similar manner, freezer door 18 includes an outer edge portion 38, which is pivoted at upper hinge 40 and a lower hinge (not shown) for movement relative to cabinet shell 5, and an inner vertical edge portion 47. As known in the art, fresh food and freezer doors 15 and 18 conceal fresh food and freezer compartments of refrigerator cabinet 2. Again, the exact construction of refrigerator 2 can vary greatly without departing from the invention.

The present invention is actually directed to the mounting of handles 60 and 61 for fresh food and freezer doors 15 and 18 respectively. Although the particular handle configuration can vary in accordance with the present invention, it is the particular mounting arrangement for one or more handles, such as handles 60 and 61, to which the present invention is particularly directed. As shown, each handle 60, 61 includes a first, elongated end portion 65, a second end portion 66, and an intermediate portion 67 interconnecting first and second end portions 65 and 66. At this point, it should be understood that the exact configuration of handles 60 and 61 merely represents a preferred arrangement and various handle designs could be readily employed without departing from the invention.

Reference will now be made to FIGS. 2-7 in describing the preferred mounting of handle 61 in accordance with the present invention and it is to be understood that handle 60 is constructed and mounted in a corresponding manner. With initial reference to FIG. 2, a plurality of base or door clip members 70 are initially mounted along inner edge portion 47 of freezer door 18, while a pair of handle clip members 75 are initially mounted within first and second end portions 65 and 66 respectively. As specifically shown in FIG. 2, inner edge portion 47 of freezer door 18 is provided with vertically spaced holes 95 and openings 98. Most preferably, each opening 98 preferably takes the form of a slot. Actually, holes 95 and openings 98 are arranged in sets, with each set containing a single hole 95 and a single opening 98 for use in mounting a respective base member 70 to the front face portion of freezer door 18 with a threaded fastener 100 as will be discussed more fully below.

Figure 4:
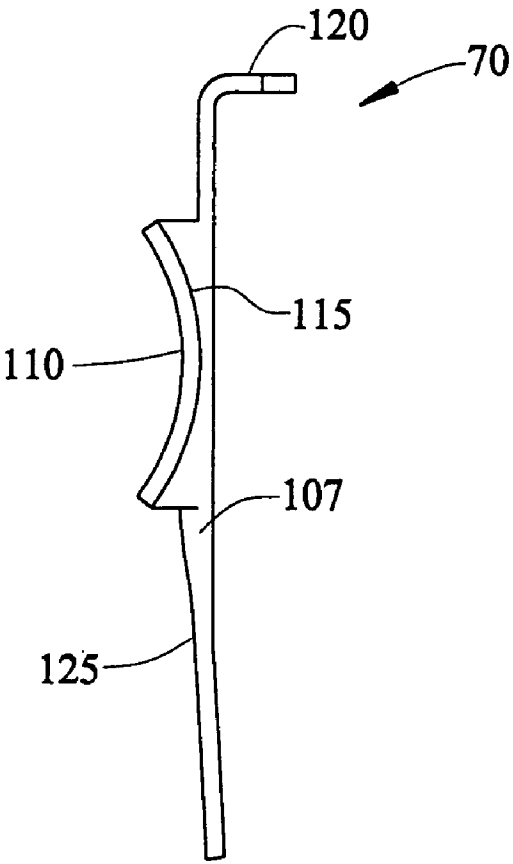
FIG. 4 is side view of the door clip member of FIG. 3.
Figure 3:
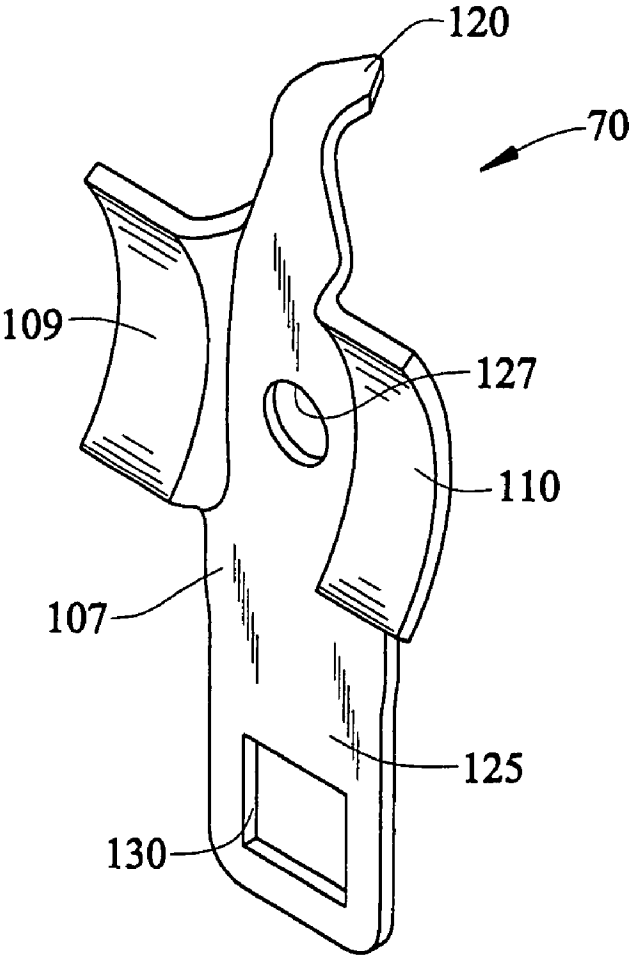
FIG. 3 is an enlarged perspective view of a door clip or base member employed in the handle arrangement of FIGS. 1 and 2.

FIGS. 3 and 4 best illustrate that, in accordance with the most preferred form of the invention, each base member 70 includes a main base section 107 which defines a pair of spaced side connectors 109 and 110. As depicted, each side connector 109, 110 is generally concave in shape, while defining an arcuate or convexly curved lower surface 115. Projecting from one end of main base section 107 is a tab member 120. Projecting from another end of main base section 107 is a leg extension 125 provided with a through hole 130, which is shown to be generally rectangular or square in shape. Main base section 107 is also provided with a substantially central aperture 127.

Each base member 70 is mounted with tab member 120 projecting into a respective opening 98, with aperture 127 being aligned with a respective hole 95. Thereafter, mechanical fastener 100, such as a sheet metal screw, extends through aperture 127 and is threadably attached to door 18 at hole 95 to fixedly secure base member 70 to door 18. In the most preferred embodiment of the invention, a total of two base members 70 are fixed to door 18, with one base member 70 being arranged juxtapose first end portion 65 and another base member 70 being provided at second end portion 66. However, at this point, it should be realized that the exact number and location of base members 70 can be readily varied without departing from the invention.

Figure 6:
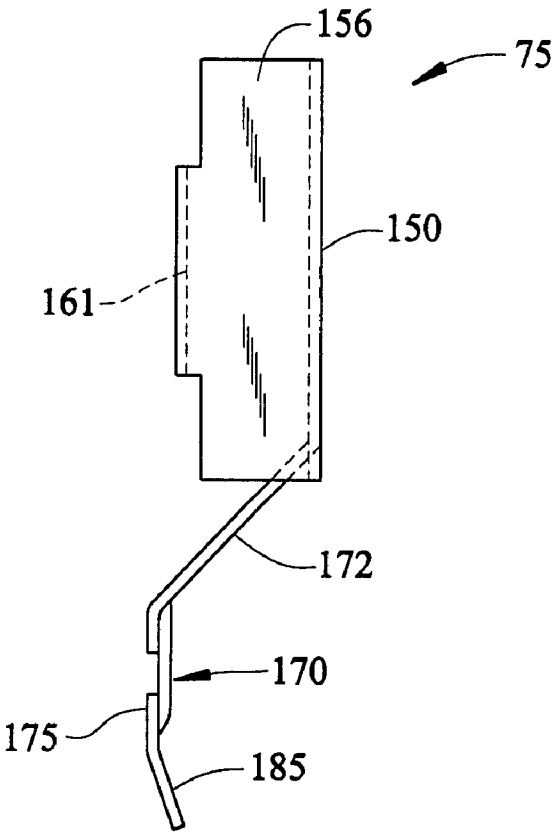
FIG. 6 is side view of the handle clip member of FIG. 5.
Figure 5:
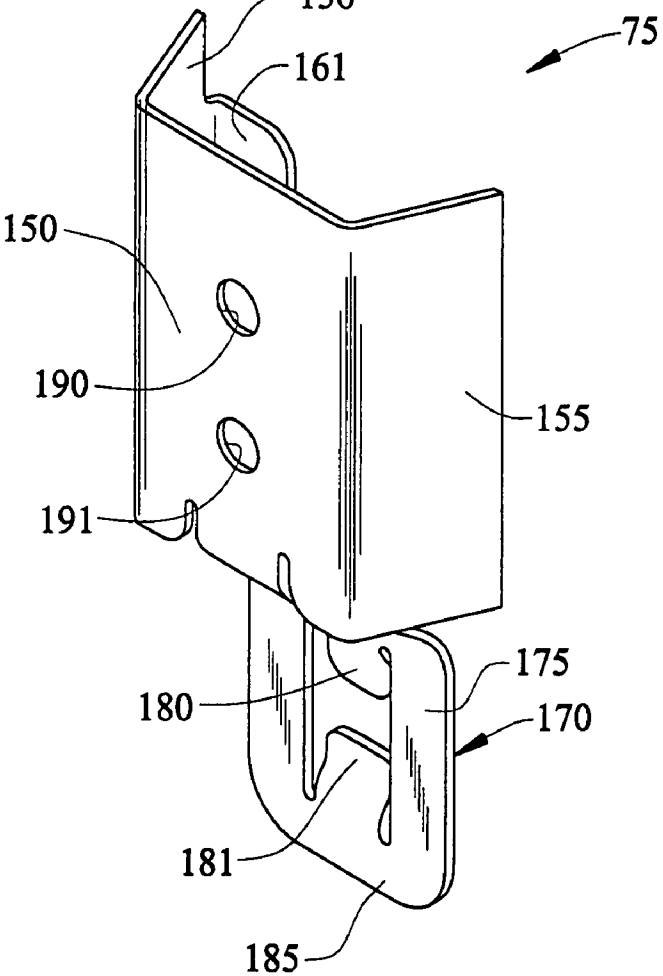
FIG. 5 is an enlarged perspective view of a handle clip member employed in the handle arrangement of FIGS. 1 and 2.
Figure 7:
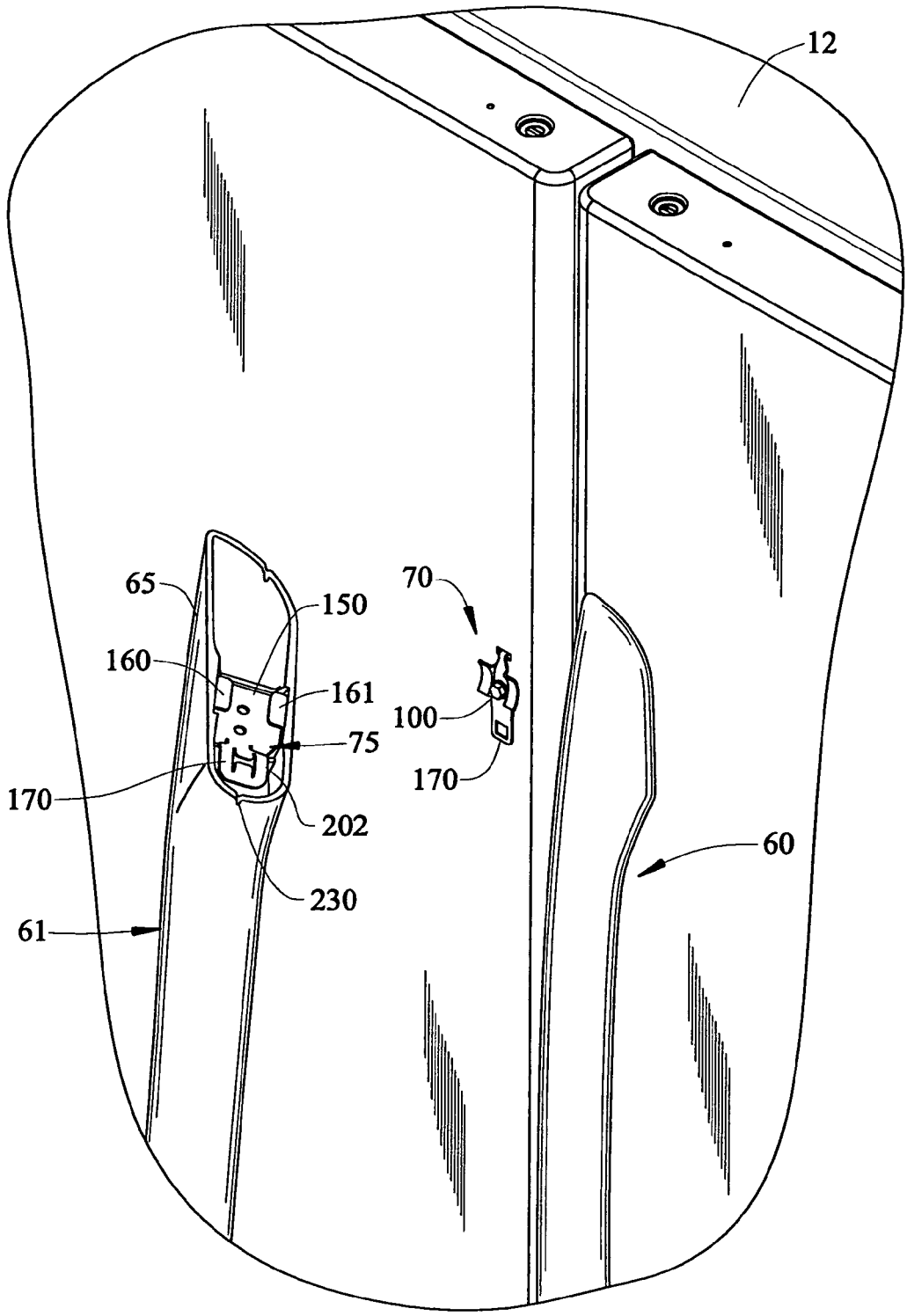
FIG. 7 is a partial exploded view, similar to that of FIG. 2, but depicting a backside of the refrigerator handle.

As best shown in FIGS. 5-7 each handle clip member 75 includes a base portion 150, upstanding side wall portions 155 and 156, in-turned flange members 160 and 161 stemming from side wall portions 155 and 156 respectively, and a cantilevered arm 170. As shown, arm 170 includes a first angled section 172 and a catch section 175. First angled section 172 preferably projects from base portion 150 a distance greater the height of side wall portions 155 and 156. In this manner, catch section 175 extends substantially parallel to flange members 160 and 161, while being spaced from base portion 150 a distance greater than flange members 160 and 161. Catch section 175 includes a pair of bend clip members 180 and 181 which extend out of a plane defined by a remainder of catch section 175. At a terminal end, arm 170 has a second angled section 185. In addition, base portion 150 is preferably provided with a pair of spaced holes 190 and 191.

Figure 8:
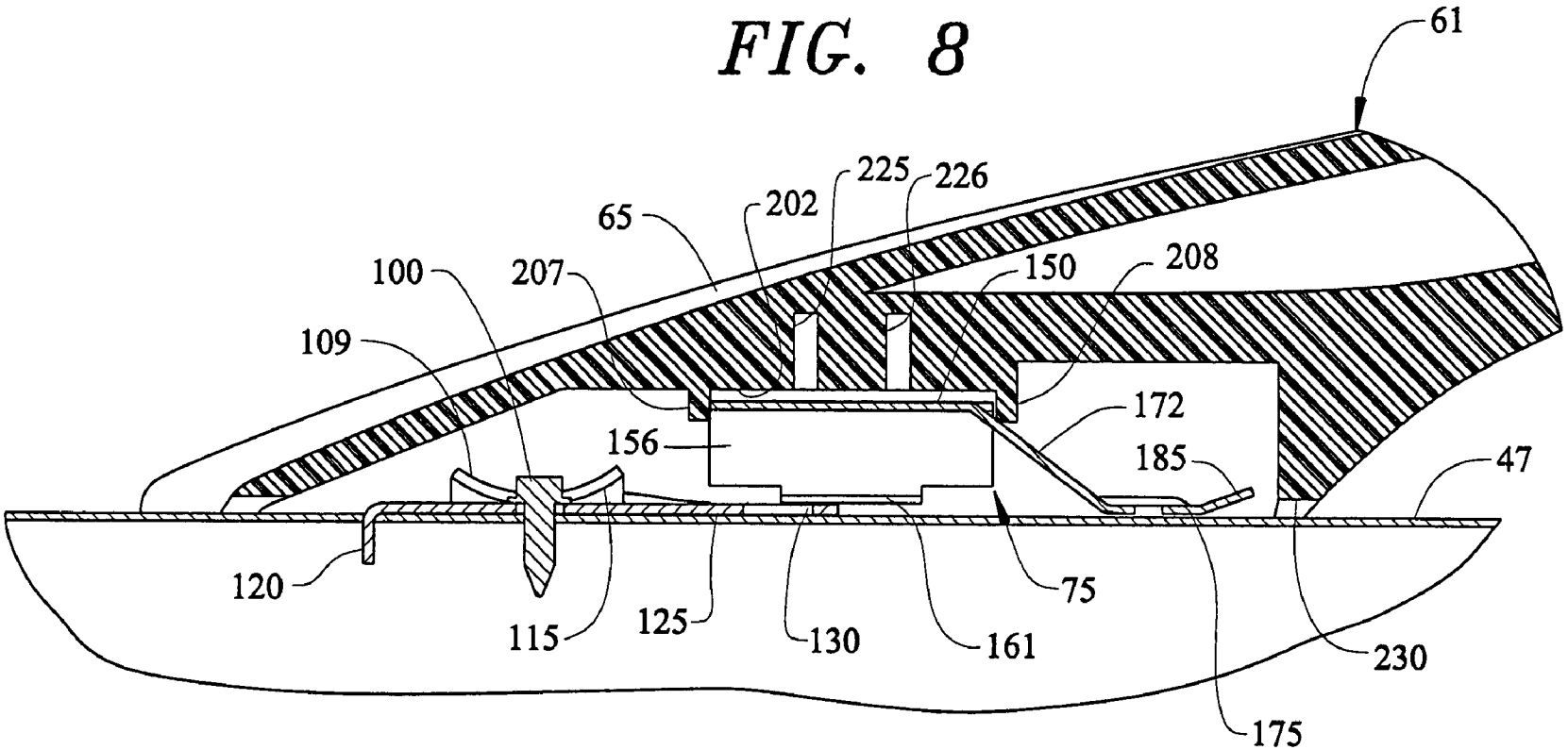
FIG. 8 is a cross-sectional side view of an end portion of the handle arrangement prior to a final attachment position.
Figure 9:
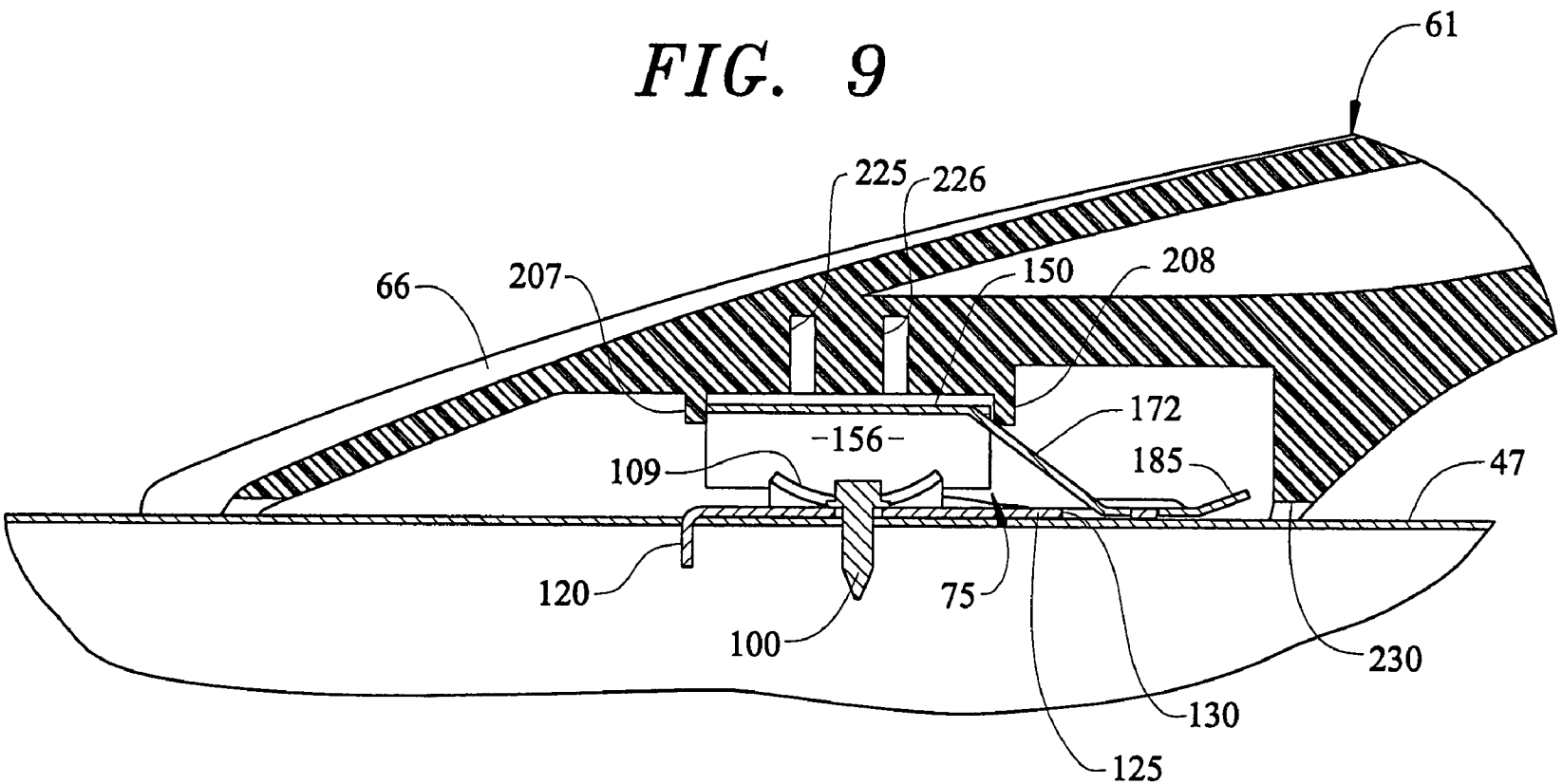
FIG. 9 is a cross-sectional side view of the end portion, similar to that of FIG. 8, but illustrating a final attachment position for the overall handle arrangement.

As best shown in FIGS. 7-9, the underside of each of first and second end portions 65 and 66 of handle 61 is formed with a recessed section 202 that defines at least support members 207 and 208. In each recessed section 202, handle 61 is preferably molded with bores 225 and 226. In addition, each end portion 65, 66 is formed with an inner passage 230. In accordance with the most preferred form of the invention, each handle clip member 75 is snap-fittingly received in a respective recessed section 202 as clearly shown in FIGS. 8 and 9. When in this position, spaced holes 190 and 191 are aligned with bores 225 and 226 such that additional, mechanical fasteners (not shown) can be utilized to further secure each handle clip member 75 within a respective recessed section 202. At this point, it should also be noted that second angled section 185 of arm 170 is arranged opposite inner passage 230.

With this arrangement, following the mounting of base members 70 to door 18 in the manner set forth above, first and second end portions 65 and 66 of handle 61 can be completely laid over base members 70, with each base member 70 being initially arranged adjacent a respective handle clip member 75 within a recessed section 202 as depicted in FIG. 8. Thereafter, the entire handle 61 is shifted or slid relative to base members 70 and door 18. Due to the shape of side connectors 109 and 110, the shifting of handle 61 causes side connectors 109 and 110 to engage flange members 160 and 161. Therefore, as handle 61 is shifted in this manner, a wedging action results that causes handle 61 to be drawn against door 18. That is, base members 70 and handle clip members 75 include mating surfaces which co-act along arcuate surfaces 115 thereof to draw handle 61 to the front face portion of door 18. With the shifting of handle 61 from the position shown in FIG. 8 to the final position shown in FIG. 9, leg extension 125 will engage arm 170 to initially deflect arm 170. Thereafter, arm 170 will snap back as a clip member 180, 181 projects into through hole 130. Once this snap connection is established, essentially simultaneously at both first and second end portions 65 and 66, handle 61 is fixed in position along door 18. If removal of handle 61 is desired, a small rod or the like can be readily inserted into inner passage 230 to deflect arm 170 at second angled section 185 out of engagement with a respective leg extension 125 in order to permit handle 61 to be slid in an opposite direction.

Figure 10:
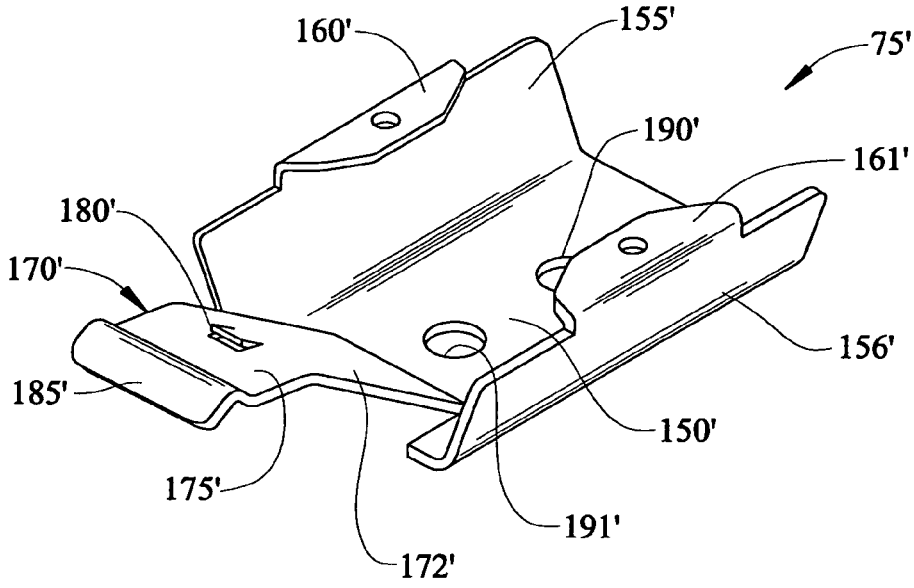
FIG. 10 is an enlarged perspective view of a handle clip member, similar to that of FIG. 5, constructed in accordance with a second embodiment of the invention.
Figure 11:
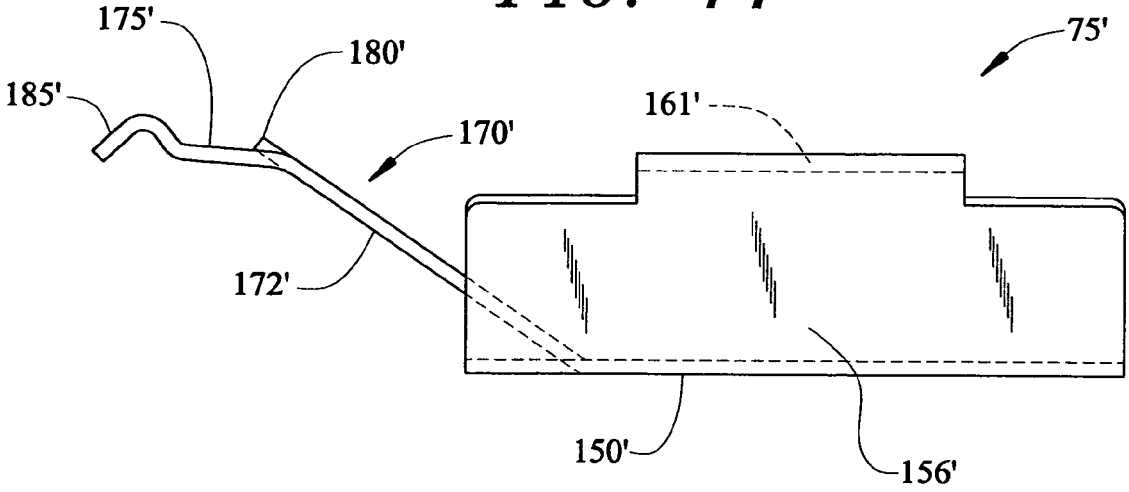
FIG. 11 is a side view of the handle clip member of FIG. 10.

With this handle mounting arrangement, handle 61 can be advantageously molded of plastic, and a tight, aesthetically appealing, as well as easily assembled, overall handle arrangement is defined. From the above discussion, it should readily recognized that clip member 181 is actually not used to lock handle 61 to base member 70. Therefore, clip member 181 on each base member 7 could be readily removed in accordance with the invention. To this end, FIGS. 10 and 11 illustrate another potential embodiment for a handle clip member 75' including a base portion 150', upstanding side wall portions 155' and 156', in-turned flange members 160' and 161' stemming from side wall portions 155' and 156' respectively, and a cantilevered arm 170'. As shown, arm 170' includes a first angled section 172', preferably extending at an angle of approximately 36° from base portion 150', leading to a catch section 175'. First angled section 172' preferably projects from base portion 150' a distance slightly greater the height of side wall portions 155' and 156'. In this manner, catch section 175' extends substantially parallel to flange members 160' and 161', while being spaced from base portion 150' a distance greater than flange members 160' and 161'. First angled section 172' is actually lanced and bent such that a clip member 180' is defined at catch section 175'. At a terminal end, arm 170' has a raised section (not separately labeled) leading to a second angled section 185'. In addition, base portion 150' is preferably provided with a pair of spaced holes 190' and 191'.

Based on the above descriptions of the embodiment of FIGS. 5 and 6 and the embodiment of FIGS. 10 and 11, it should be readily apparent that clip members 75 and 75' are similarly constructed and utilized in accordance with the invention. For this reason, the manner in which each handle 60, 61 is mounted utilizing base members 70 and a pair of handle clip members 75' will not be duplicated here. However, at this point, it should be realized that inner passage 230 need not be specifically provided. Instead, a gap in the order of 0.030 inches (0.076 cm) can be maintained between each end portion 65, 66 and door 18 in order to enable a thin blade, such as a plastic credit or key card) to be slipped there between in order to detach handle 60, 61.

Although described with reference to preferred embodiments of the invention, it should be understood that various changes and/or modifications can be made without departing from the spirit of the invention. For instance, although described with reference to a side-by-side style refrigerator, a corresponding handle arrangement could be equally employed in a top or bottom mount style refrigerator as well. In addition, although described with reference to the use of identical connection arrangements at first and second end portions 65 and 66, it should be realized that only one end connection needs to be provided with the snap connection, i.e., one set of connectors need not incorporate leg extension 125 and arm 170, 170'. With this configuration, handle 61 is held tight to door 18 at both ends, but only locked in position at a single end. In any event, the invention is only intended to be limited in accordance with scope of the following claims.

We claim:

1. A refrigerator comprising:

a cabinet defining an interior compartment;

at least one door, having a front face portion, pivotally mounted to the cabinet for selectively accessing the interior compartment; and a handle assembly for pivoting the door relative to the cabinet, said handle assembly including:

at least first and second base members fixed to the door at spaced locations along the front face portion;

at least first and second handle clip members; and a handle member including first and second end portions separated by an intermediate portion, said first and second handle clip members being respectively mounted to the first and second end portions of the handle member, the first end portion of the handle member being positioned over the first base member, while the second end portion of the handle member is positioned over the second base member wherein, upon shifting of the handle member relative to the first and second base members, the first and second base members and the first and second handle clip members include relative tapered surface portions that, become engaged and co-act to increasingly draw said handle member against the front face portion of the door and secure the handle member to the door, with the intermediate portion being spaced from the front side of the door to enable the handle to be grasped in order to selectively open and close the door.

2. The refrigerator according to claim 1, wherein the front face portion of the door is provided with a plurality of spaced openings, each of the base members including a tab element adapted to project into a respective one of the plurality of spaced openings.

3. The refrigerator according to claim 2, wherein each of the plurality of spaced openings takes the form of a slot.

4. The refrigerator according to claim 2, wherein the front face portion of the door further includes a plurality of holes adjacent corresponding ones of said plurality of spaced openings, said base members being further attached to the door at the openings.

5. The refrigerator according to claim 4, wherein the first and second end portions of the handle member include recessed sections within which the first and second handle clip members are mounted.

6. The refrigerator according to claim 5, wherein the handle member is molded of plastic.

7. The refrigerator according to claim 1, wherein the first handle clip member includes a cantilevered arm which is snap-connected to the first base member.

8. The refrigerator according to claim 7, wherein the handle member is formed with an inner passage exposed to the cantilevered arm.

9. The refrigerator according to claim 7, wherein the first handle clip member includes a catch section which projects into a through hole formed in the first base member in order to interengage the first base member and the first handle clip member.

10. The refrigerator according to claim 1, wherein the base members include connectors which frictionally engage the handle clip members.

11. The refrigerator according to claim 10, wherein each of the connectors is generally concave in shape.

12. The refrigerator according to claim 10, wherein each of the base members includes a pair of spaced connector elements.

13. The refrigerator according to claim 12, wherein the handle clip members include in-turned flanges received between the connectors and the front face portion.

14. A method of attaching a handle member to a front face portion of a refrigerator door comprising:

fixedly securing a plurality of base members at spaced locations along a portion of the front face portion of the door;

mounting handle clip members in the handle member;

positioning the handle member over the plurality of base members; and sliding the handle member relative to the refrigerator door to interconnect the base members and the handle clip members while simultaneously, increasing drawing the handle member against the front face portion of the door, wherein the handle clip members interact with the base members along relative tapered surfaces to draw the handle member further against the front face portion of the door upon sliding the handle member relative to the refrigerator door.

15. The method of claim 14, wherein each of the plurality of base members is attached to the door with a tab element provided on the base member extending into an opening formed in the front face portion of the door.

16. The method of claim 15, wherein each of the plurality of base members is further attached to the door through a mechanical fastener.

17. The method of claim 14, further comprising: snap-connecting a cantilevered arm of at least one of the handle clip members to a leg extension portion of a respective one of the base members.

18. The method of claim 17, further comprising: selectively disconnecting the cantilevered arm from the leg extension by manually deflecting the cantilevered arm.

19. An appliance comprising:

a cabinet defining an interior compartment;

at least one door, having a front face portion, pivotally mounted to the cabinet for selectively accessing the interior compartment; and a handle assembly for pivoting the door relative to the cabinet, said handle assembly including:

at least first and second base members fixed to the door at spaced locations along the front face portion;

at least first and second handle members; and a handle including first and second end portions separated by an intermediate portion, said first and second handle members being respectively mounted to the first and second end portions of the handle, the first end portion of the handle being positioned over the first base member, while the second end portion of the handle is positioned over the second base member;

means for increasingly drawing said handle against the front face portion of the door to secure the handle to the door upon shifting of the handle relative to the first and second base members; and means, acting between the first and second base members and the first and second handle members, for releasably securing the handle to the door.

* * * * *